US009540877B2

(12) United States Patent
Lanning et al.

(10) Patent No.: US 9,540,877 B2
(45) Date of Patent: Jan. 10, 2017

(54) DRILLING MOTOR VALVE AND METHOD OF USING SAME

(75) Inventors: Curtis Lanning, Montgomery, TX (US); Dong Phung, Spring, TX (US); Aaron Schen, The Woodlands, TX (US); Jacob Riddel, Humble, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 542 days.

(21) Appl. No.: 14/110,145

(22) PCT Filed: Nov. 8, 2011

(86) PCT No.: PCT/US2011/059789

§ 371 (c)(1),
(2), (4) Date: Oct. 31, 2013

(87) PCT Pub. No.: WO2012/138383

PCT Pub. Date: Oct. 11, 2012

(65) Prior Publication Data

US 2014/0041943 A1 Feb. 13, 2014

Related U.S. Application Data

(60) Provisional application No. 61/473,614, filed on Apr. 8, 2011.

(51) Int. Cl.
*E21B 4/02* (2006.01)
*E21B 6/02* (2006.01)
(Continued)

(52) U.S. Cl.
CPC . *E21B 6/02* (2013.01); *E21B 4/02* (2013.01); *E21B 4/06* (2013.01); *E21B 4/14* (2013.01);
(Continued)

(58) Field of Classification Search
CPC ..... E21B 4/02; E21B 4/14
See application file for complete search history.

(56) References Cited

U.S. PATENT DOCUMENTS 2,743,083 A 4/1956 Zublin
2,780,438 A 2/1957 Bielstein
(Continued)

FOREIGN PATENT DOCUMENTS

GB 762749 12/1956
WO 2008007066 1/2008
WO 2012138383 10/2012

OTHER PUBLICATIONS

International Search Report for PCT Patent Application No. PCT/US2011/059789 dated Nov. 23, 2013, 5 pages.
(Continued)

*Primary Examiner* — Giovanni C Wright
(74) *Attorney, Agent, or Firm* — Conley Rose, P.C.

(57) ABSTRACT

A valve (11) for controlling the flow of a drilling fluid through a down-hole tool (10) positionable in a wellbore penetrating a subterranean formation. The down-hole tool has a housing with a drilling motor therein and a drill bit (1) at an end thereof. The drilling motor (9) has a housing with a rotor (206) rotationally movable in a rotor channel (204) as the drilling fluid passes through a rotor channel between the housing and the rotor. The rotor has a bypass channel therethrough for bypassing a portion of the drilling fluid therethrough. The valve includes a valve plate positionable upstream of the motor. The valve plate (200) has at least one flow passage (226) and at least one bypass passage (220) therethrough. The flow passage is in fluid communication with the rotor channel for passing the drilling fluid therethrough. The bypass passage is in selective fluid communication with the bypass channel when the rotor rotates about the housing and moves the bypass channel into alignment
(Continued)

with at least a portion of the bypass passage for bypassing a portion of the drilling fluid therethrough whereby a hammering effect is generated on the bit.

18 Claims, 10 Drawing Sheets

(51) Int. Cl.

| | |
|---|---|
| ***E21B 4/14*** | (2006.01) |
| ***E21B 21/10*** | (2006.01) |
| ***E21B 34/06*** | (2006.01) |
| ***F01C 1/107*** | (2006.01) |
| ***F04C 2/107*** | (2006.01) |
| ***F04C 13/00*** | (2006.01) |
| ***F04C 14/26*** | (2006.01) |
| ***E21B 4/06*** | (2006.01) |

(52) U.S. Cl.
CPC ..... *E21B 21/103* (2013.01); *E21B 34/06* (2013.01); *F01C 1/107* (2013.01); *F04C 2/1073* (2013.01); *F04C 13/008* (2013.01); *F04C 14/26* (2013.01); *F04C 2240/603* (2013.01); *F04C 2270/12* (2013.01)

(56) References Cited

U.S. PATENT DOCUMENTS

| | | | | |
|---|---|---|---|---|
| 2,963,099 | A | 12/1960 | Gianelloni | |
| 3,840,080 | A | 10/1974 | Berryman | |
| 4,114,702 | A * | 9/1978 | Maurer | E21B 4/003 175/107 |
| 4,275,795 | A | 6/1981 | Beimgraben et al. | |
| 4,768,598 | A | 9/1988 | Reinhardt | |
| 4,819,745 | A | 4/1989 | Walter | |
| 4,830,122 | A | 5/1989 | Walter | |
| 4,979,577 | A | 12/1990 | Walter | |
| 5,009,272 | A | 4/1991 | Walter | |
| 5,190,114 | A | 3/1993 | Walter | |
| 6,289,998 | B1 * | 9/2001 | Krueger | E21B 7/18 175/107 |
| 6,508,317 | B2 | 1/2003 | Eddison et al. | |
| 6,604,922 | B1 | 8/2003 | Hache | |
| 6,742,609 | B2 | 6/2004 | Gillis et al. | |
| 7,086,486 | B2 | 8/2006 | Ravensbergen et al. | |
| 7,523,792 | B2 | 4/2009 | El-Rayes et al. | |
| 2005/0211471 | A1 | 9/2005 | Zupanick | |
| 2006/0243493 | A1 | 11/2006 | El-Rayes et al. | |
| 2009/0095528 | A1 | 4/2009 | Hay et al. | |
| 2011/0073374 | A1 * | 3/2011 | Bunney | E21B 4/02 175/107 |

OTHER PUBLICATIONS

International Preliminary Report on Patentability and Written Opinion for PCT Patent Application No. PCT/US2011/059789 dated Oct. 8, 2013, 6 pages.

Examination Report for Canadian Patent Application No. 2,832,212 dated Nov. 28, 2014, 3 pages.

* cited by examiner

DRILLING MOTOR VALVE AND METHOD OF USING SAME

CROSS-REFERENCE TO RELATED APPLICATION

This application is a National Stage Application of International Application No. PCT/US2011/059789, and claims priority to U.S. Provisional Application No. 61/473,614, the entire contents of which are hereby incorporated by reference.

BACKGROUND

1. Field

This disclosure relates generally to techniques for performing wellsite operations. More specifically, the disclosure relates to techniques, such as drilling motors (and related valves) used in drilling wellbores.

2. Description of Related Art

In the oil and gas exploration and production industry, subsurface formations are accessed by drilling boreholes from the surface. Typically, a drill bit is mounted on the lower end of a tubular string of pipe (referred to as a "drill string"), and advanced into the earth from the surface to form a wellbore. A drilling motor is positioned along the drill string to perform various functions, such as providing power to the drill bit to drill the wellbore. Drilling fluid or "mud" may be pumped down through the drill string from the surface and exited through nozzles in the drill bit. The drilling fluid may carry drill cuttings out of the borehole, and back up to the surface through an annulus between the drill pipe and the wellbore wall. As the fluid passes through the drilling mud motor, a rotor positioned in a stator of the drilling motor may be driven.

A conventional drilling mud motor may be, for example, a progressive cavity or Moineau motor having helical fixed stator with a rotational rotor positioned therein. Typically, the rotor has multiple spiral lobes for engaging a greater number of spiral grooves formed in the rubber stator. Drilling mud (or other suitable fluid) may be pumped into the space between the rotor and the stator. The drilling mud may be pumped through the motor and forced along a progressive cavity therein, thereby causing the rotor to rotate in an eccentric manner. Other drilling motors, such as turbine driven motors with turbine rotors have also been developed.

In some cases, it may be desirable to control the flow of fluid as it passes through the drill string as described, for example, in U.S. Pat. Nos. 7,086,486, 4,979,577, and 4,275,795. The fluid flow may be used in an attempt to provide a percussive or hammer effect as described in U.S. Pat. No. 6,508,317, which hereby is incorporated by reference herein.

Despite the development of techniques for controlling fluid flow through a drill string, there remains a need to provide advanced techniques for controlling flow. It may be desirable to provide techniques that may be used to assist in preventing the drilling tool from sticking in the wellbore. It may be further desirable that such techniques reduce vibration and/or increase drilling efficiency in the downhole tool, while preventing damage to the bit. This disclosure is directed to fulfilling this need in the art.

SUMMARY

The disclosure relates to a valve for a drilling motor. The valve has a passage for passing fluid into a rotor channel in the motor for rotation of a rotor therein, and a bypass for passing fluid through a bypass channel in the rotor. The bypass is selectively alignable with the bypass channel for selectively permitting fluid to bypass therethrough. The disclosure relates to a valve of a drilling motor used to control the flow of fluid passing through a motor rotor of the drilling motor. The valve may be used, for example, to selectively provide pressure pulses in the fluid flowing through the drilling motor, for example at a pre-set pressure and/or torque level. The valve may also be used to provide high speed oscillations in the rotational speed of the bit, and/or to adjust the torque of the drilling motor to selectively slow bit rotations, thereby providing pressure spikes to generating a hammer effect in the torque at the bit. The fluid flow may be varied to reduce torsional (or lateral) vibration in the motor, to aid in the prevention of stick-slip, and/or to aid in the prevention of sticking of the drilling tool in the wellbore. The fluid flow may also be varied to increase drilling efficiency (e.g., faster penetration rates for similar weight on bit and reduced reactive torque).

In at least aspect, the disclosure relates to a valve for controlling the flow of a drilling fluid through a downhole tool positionable in a wellbore penetrating a subterranean formation. The downhole tool includes a drill bit at an end thereof and a drilling motor. The drilling motor has a housing with a rotor movable in a rotor channel in the housing as the drilling fluid passes therethrough. The rotor has a bypass channel for bypassing a portion of the drilling fluid therethrough.

The valve includes a valve plate (or plate valve) positionable upstream of the motor. The valve plate has at least one flow passage and at least one bypass passage therethrough. The flow passage is in fluid communication with the rotor channel for passing the drilling fluid therethrough whereby the rotor is rotatable in the housing. The bypass passage is in selective fluid communication with the bypass channel when the rotor moves about the housing and the bypass channel selectively moves into alignment with at least a portion of the at least one bypass passage for bypassing a portion of the drilling fluid therethrough whereby a hammering effect is generated on the bit.

The rotor may be a helical rotor orbiting within a helical stator in the housing, or a turbine rotatable within the housing. The bypass passage may be offcenter to an axis of rotation of the rotor. The rotor channel may be offcenter to the axis of rotation of the rotor. The valve plate may include a central hub and an outer ring with at least one spoke defining at least one rotor passage therebetween.

The valve may include a nozzle, a rotor catch, a catch ring, and/or a wear tip. The wear tip may be directly or indirectly coupled to the rotor. The bypass passage may include a plurality of bypass passages. The bypass channel may be positionable in full alignment, partial alignment, or non-alignment with the bypass passage.

In another aspect, the disclosure relates to a downhole tool positionable in a wellbore penetrating a subterranean formation. The downhole drilling tool has a drill string with a drill bit at an end thereof, and a drilling fluid passing therethrough. The downhole tool includes a drilling motor positionable in the drill string. The drilling motor includes a housing and a rotor rotationally movable in a rotor channel in the housing as the drilling fluid passes through a rotor channel between the housing and the rotor. The rotor has a bypass channel for bypassing a portion the drilling fluid therethrough. The downhole tool also includes a valve positionable upstream of the motor for controlling the flow of the drilling fluid therethrough.

The valve includes a valve plate positionable upstream of the motor, The valve plate has at least one flow passage and at least one bypass passage therethrough, The flow passage is in fluid communication with the rotor channel for passing the drilling fluid therethrough, The bypass passage is in selective fluid communication with the bypass channel when the rotor rotates about the housing and moves the bypass channel into alignment with at least a portion of the at least one bypass passage for bypassing a portion of the drilling fluid therethrough whereby a hammering effect is generated on the bit.

The motor may also include a helical stator and the rotor may be a helical rotor orbiting therein. The rotor may be a turbine rotatable about an axis of the downhole tool. The downhole tool may also include a regulator for selectively restricting flow to the bypass channel. The regulator may be operatively connectable to an upstream end of the rotor.

The regulator may include a housing with a clutch for selectively rotating a regulating rotor at a given pressure is reached whereby the regulating rotor selectively allows the drilling fluid to pass into the at least one bypass passage. The regulator may include a retractable piston for selectively allowing the drilling fluid to pass therein and rotate the regulating rotor, or a brake selectively releasable to permit rotation of the regulating rotor.

Finally, in another aspect, the disclosure relates to a method of controlling the flow of a drilling fluid through a downhole tool positionable in a wellbore penetrating a subterranean formation. The downhole tool including a drill bit at an end thereof and a drilling motor. the drilling motor including a housing with a rotor movable in a rotor channel in the housing as the drilling fluid passes therethrough. The rotor has a bypass channel for bypassing a portion of the drilling fluid therethrough.

The method involves positioning a valve plate upstream of the motor. The valve plate has at least one flow passage and at least one bypass passage therethrough. The flow passage is in fluid communication with the rotor channel. The bypass passage is in selective fluid communication with the bypass channel when the rotor rotates about the housing and moves the bypass channel into alignment with the bypass passage. The method further involves rotating the rotor by passing the drilling fluid through the flow passage and into the rotor channel, and creating a hammering effect by selectively bypassing a portion of the drilling fluid through the plate bypass and into the bypass channel when the bypass channel moves into alignment with at least a portion of the bypass passage. The method may also involve regulating fluid flow into the valve plate, and selectively passing fluid into the bypass channel.

BRIEF DESCRIPTION OF THE DRAWINGS

So that the above recited features and advantages of the present disclosure can be understood in detail, a more particular description of the disclosure, briefly summarized above, may be had by reference to the embodiments thereof that are illustrated in the appended drawings. It is to be noted, however, that the appended drawings illustrate only typical embodiments of this disclosure and are, therefore, not to be considered limiting of its scope, for the disclosure may admit to other equally effective embodiments. The figures are not necessarily to scale and certain features, and certain views of the figures may be shown exaggerated in scale or in schematic in the interest of clarity and conciseness.

DETAILED DESCRIPTION

The description that follows includes apparatus, methods, techniques, and instruction sequences that embody techniques of the present subject matter. However, it is understood that the described embodiments may be practiced without these specific details.

Figure 1:
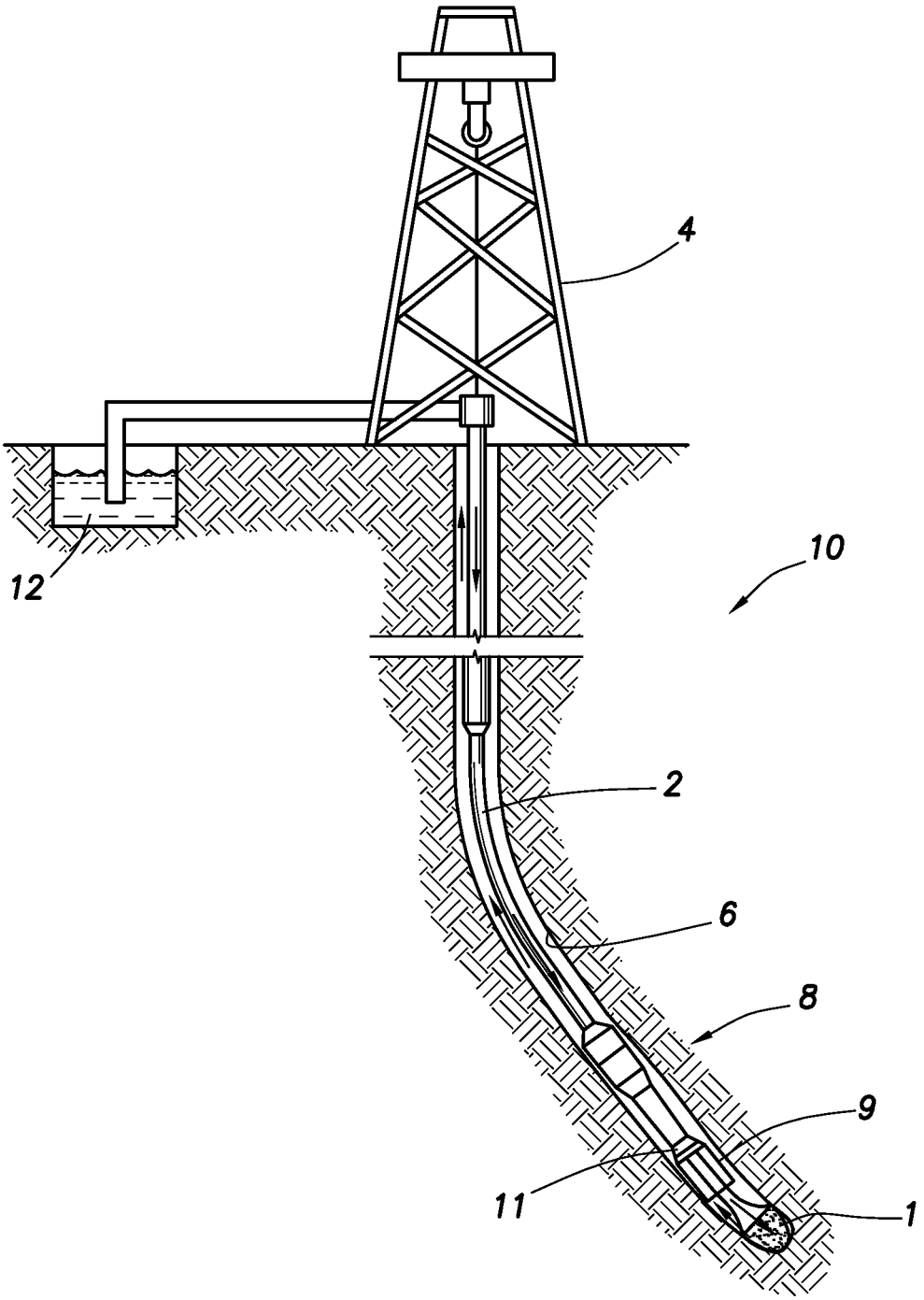
FIG. 1 is a schematic view, partially in cross-section, of a drill rig having a downhole tool including a drill string, a drilling motor with a valve, and a drill bit advanced into the earth to form a wellbore.

FIG. 1 shows schematically a representation of a downhole tool 10 comprising a drill string 2 and a drill bit 1 on a lower end thereof. The drill string is suspended from a derrick 4 for drilling a borehole 6 into the earth. A bottom-hole assembly (BHA) 8 is located at a lower end of the drill string 2 above the drill bit 1. The BHA 8 may have drilling motor 9 with a valve 11 in accordance with the disclosure.

A drilling mud (or fluid) is pumped from a mud pit 12 and through the drill string 2 as indicated by the arrows. As drilling mud passes through the drill string 2, the drilling mud drives and powers the drilling motor 9. The drilling motor 9 is provided with the valve 11 for selectively bypassing a portion of fluid flowing into the drilling motor 9 as will be described further herein. The drilling motor 9 is used to rotate and advance the drill bit 1 into the earth. The drilling mud passing through the drilling motor 9, exits the drill bit 1, returns to the surface and is re-circulated through the drill string 2 as indicated by the arrows.

While FIG. 1 depicts a certain configuration of a downhole tool 10 of a wellsite, the downhole tool may be any one of numerous types well known to those skilled in the drilling industry. There are numerous arrangements and configurations possible for drilling wellbores into the earth, and is not intended to be limited to a particular configuration.

Figure 2A:
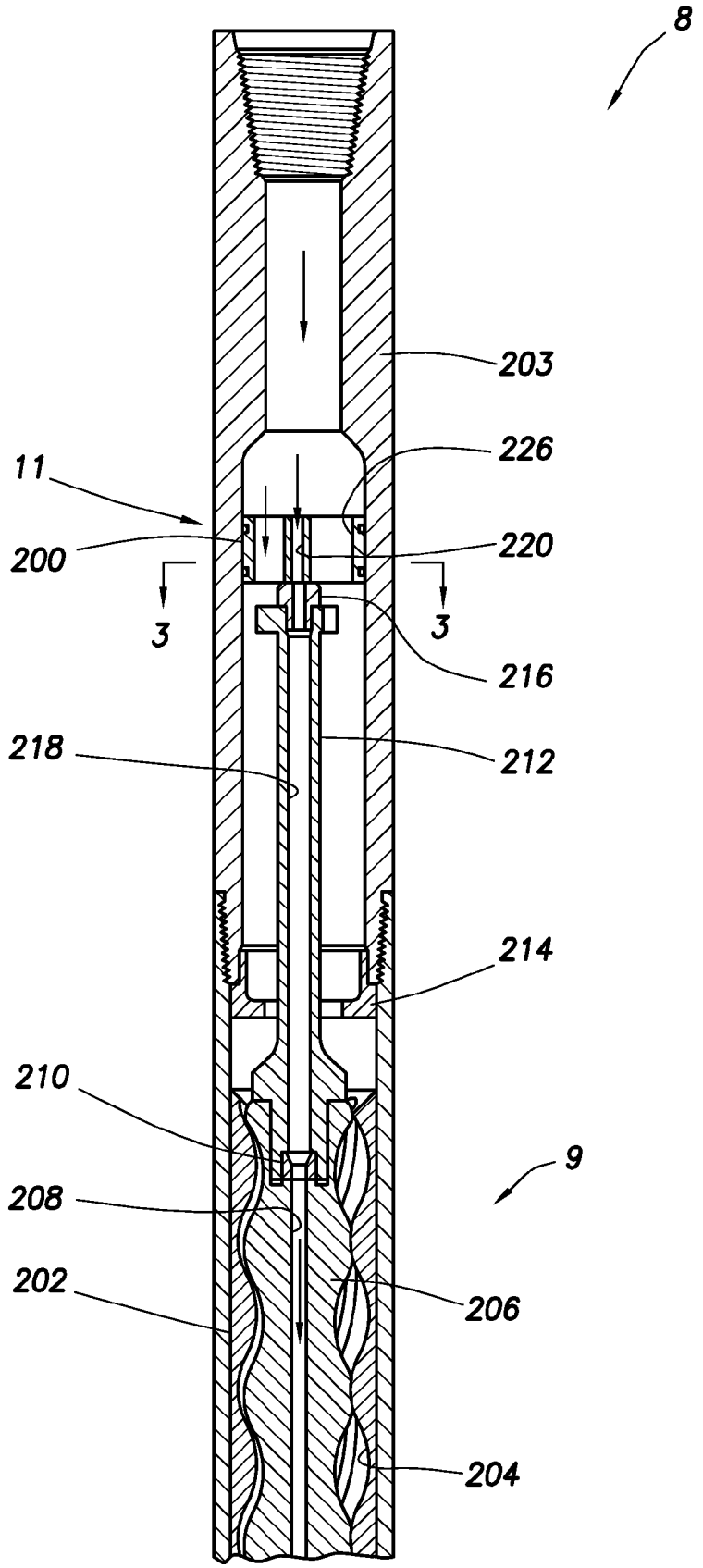
FIGS. 2A and 2B show longitudinal cross-sectional and exploded views, respectively, of a portion of a bottom hole assembly (BHA) of a downhole tool having a drilling motor with a valve in accordance with the disclosure.
Figure 2B:
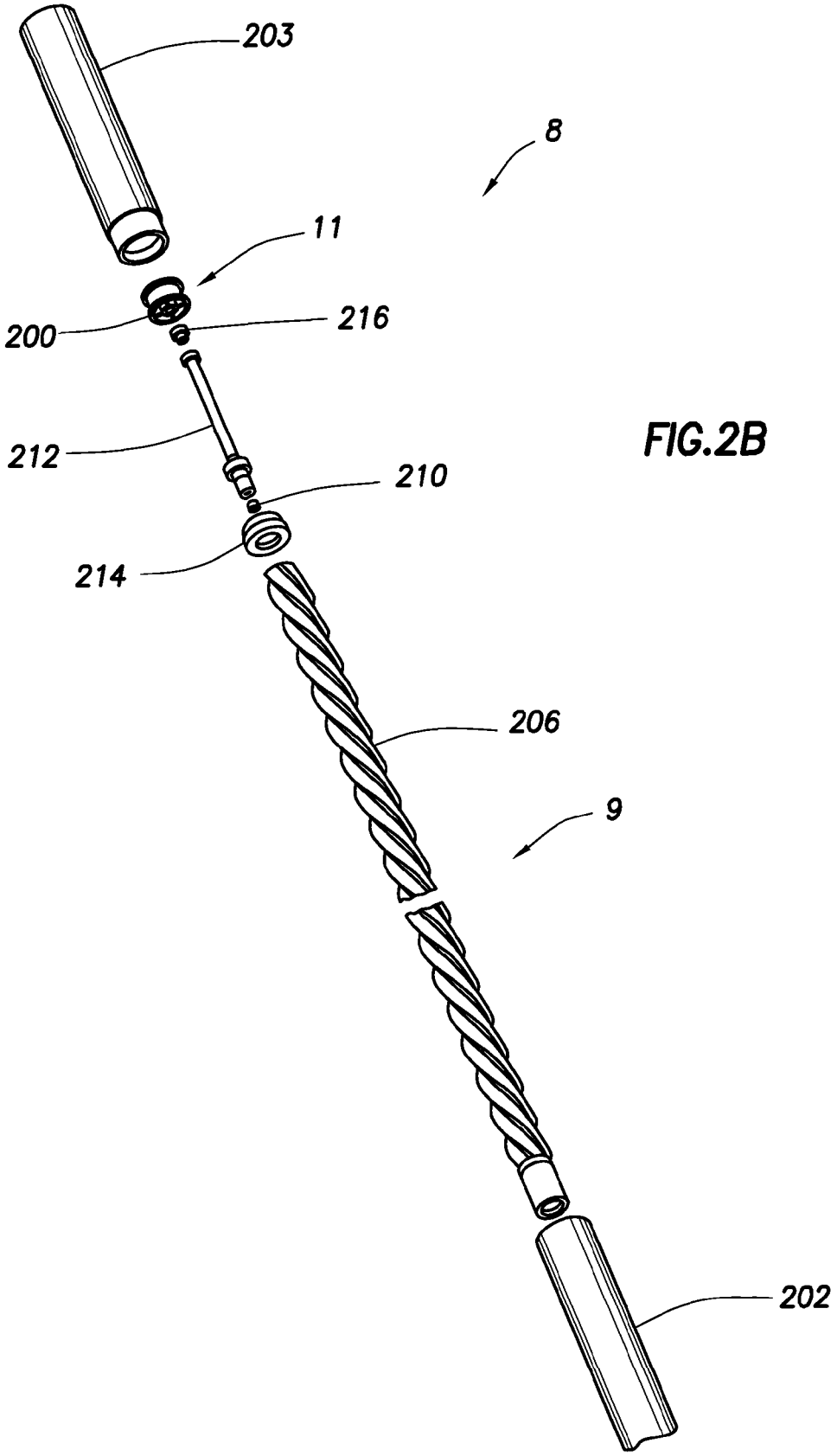

FIGS. 2A and 2B show cross-sectional and exploded views, respectively, of the drilling motor 9 and valve 11 of BHA 8 of the downhole tool 10 of FIG. 1. As shown in FIG. 2A, the valve 11 includes a valve plate 200 upstream from the drilling motor 9. The valve plate 200 may be positioned in a sub (or drill pipe) 203 operatively connected to an uphole end of the drilling motor 9.

The drilling motor 9 has a motor stator 202 with a rotor channel 204 therethrough, and a motor rotor 206 with a bypass channel 208 therethrough. The drilling motor 9 may optionally be provided with other features, such as a nozzle 210, rotor catch 212 catch ring 214, and wear tip 216. Depending on the configuration, some or all of these features may be fixed relative to the rotor 206 or coupled for rotation therewith. These features have a passage 218 therethrough in fluid communication with the bypass channel 208 for passing of fluid therethrough.

The valve plate 200 has a flow passage 226 in fluid communication with the rotor channel 204 for passing fluid therethrough and rotating the rotor 206. The valve plate 200 has a plate bypass (or bypass passage) 220 therethrough that is positioned for selective fluid communication with the bypass channel 208 for selectively bypassing a portion of the drilling fluid therethrough. The valve plate 200 may be provided with a locking mechanism (not shown), such as an o-ring, key, spline or other connector, for fixedly securing the valve plate 200 in place relative to the motor stator 202. The configuration of the valve plate 200 adjacent the motor rotor 206 may be used to provide an integrated motor/valve configuration to reduce space within the drill string.

FIGS. 3A-3F are cross-sectional views a portion of BHA 8 of FIG. 2A taken along line 3-3 depicting the operation of the valve plate 200. These figures also show an example sequence of movement the motor rotor 206 may take as fluid flows through the drilling motor 9 (see, e.g., FIG. 2A). The motor rotor 206 rotates within the rotor channel 204 of the motor stator 202. The motor rotor 206 may move from a first position in FIG. 3A, sequentially through the positions of FIGS. 3B-3D, and to a final position in FIG. 3E as indicated by the arrow.

Figure 3B:
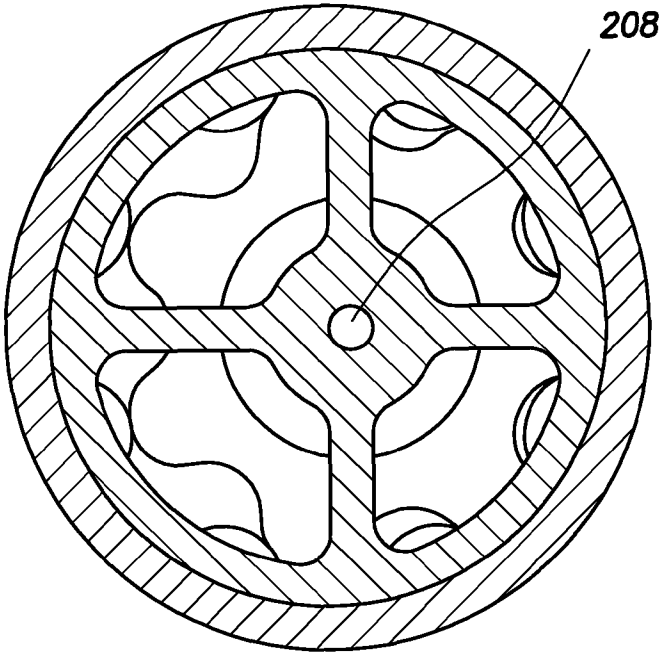
FIGS. 3A-3F are cross-sectional views of the valve of FIG. 2A taken along line 3-3 depicting a valve plate in various positions.

As shown in FIGS. 3A-3E, the plate bypass 220 of the valve plate 200 is at a fixed position in the center of the valve plate 200. The plate bypass 220 is shown as being in a central portion of the hub 320, but may be located anywhere along the valve plate 200 that will allow selective fluid communication with the bypass channel 208. As shown in FIG. 3F, an additional plate bypass 220' may be provided. One or more plate bypasses 220, 220' of any shape may be provided.

The valve plate 200 comprises a central hub 320 and an outer ring 322 with spokes 324 extending therebetween. Flow passages 226 are defined between the hub 320, the outer ring 322 and the spokes 324. The flow passages 226 may be used to permit the flow of fluid through the valve plate 200 and into the rotor channel 204 to power the motor 9 and drive the rotor. While a hub and spokes configuration is depicted, the valve plate may have various shapes for providing fluid flow to the motor.

Portions of the fluid may be selectively bypassed through the bypass channel 208 via the plate bypass 220 as the motor rotor 206 passes behind the valve plate 200. The plate bypass 220 is shown extending through a center of the hub 320. Depending on the position of the motor rotor 206 as it rotates within the rotor channel 204, the plate bypass 220 is selectively in fluid communication with the bypass channel 208. This selective fluid communication interrupts the flow of fluid passing through the motor 9. The valve plate 200 may be sized and shaped such that the plate bypass 220 is exposed to the bypass channel 208 of the orbiting motor rotor 206. As the motor rotor 206 orbits within the motor stator 202, the bypass channel 208 orbits about the plate bypass 220 into and out of alignment with the plate bypass 220 thereby causing the area available for the fluid flow to increase and decrease as the motor rotor 206 turns.

Figure 3A:
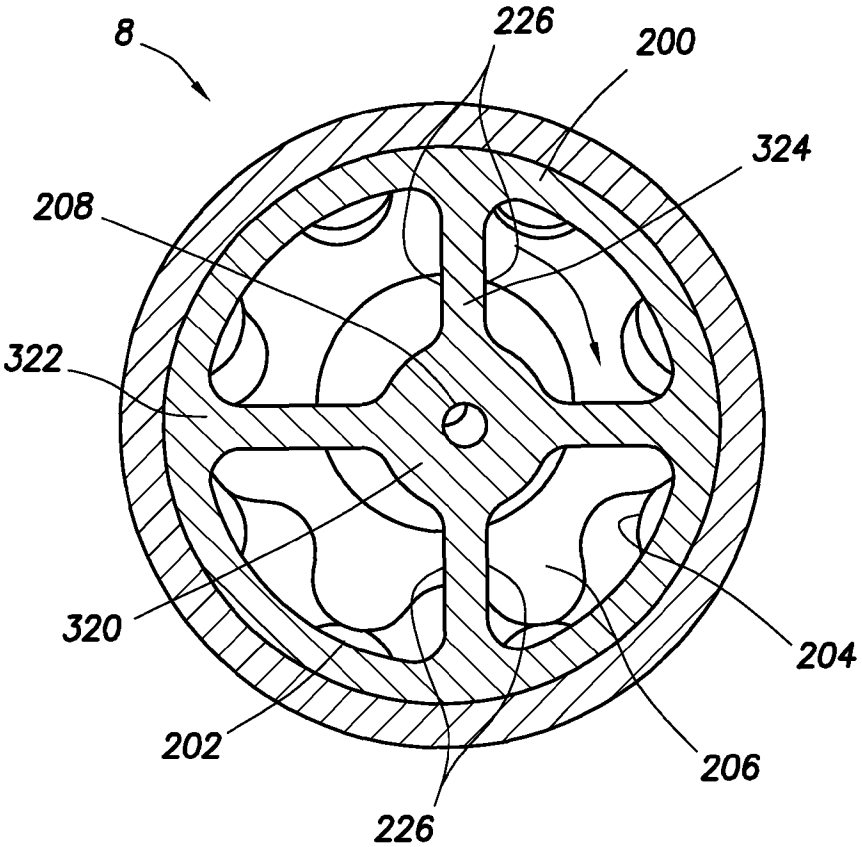
Figure 3D:
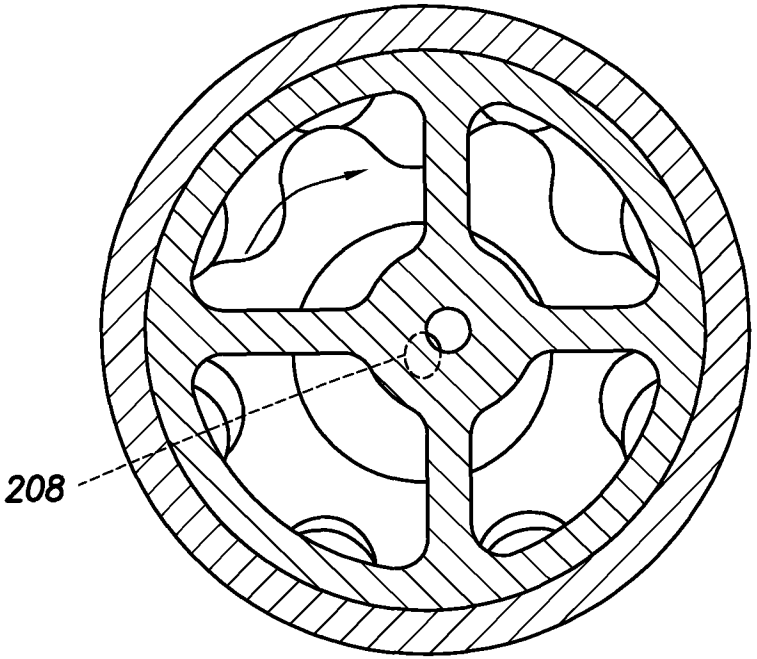
Figure 3C:
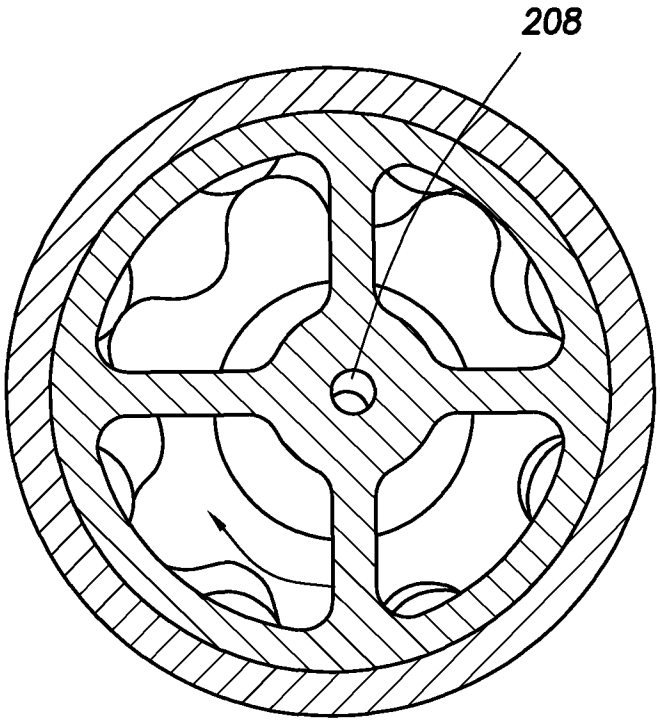
Figure 3F:
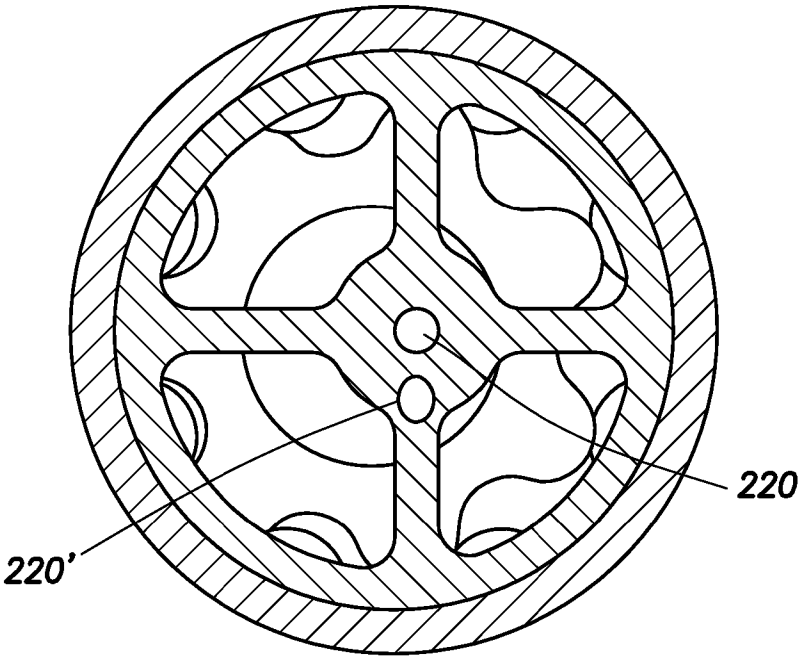
Figure 3E:
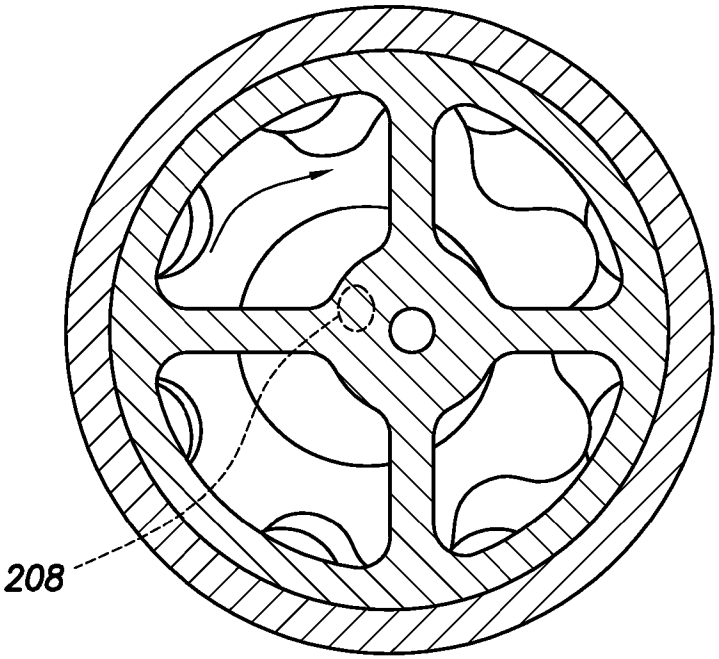

As shown in FIGS. 3A, 3C and 3D, the plate bypass 220 may be in at least partial alignment with (partially open to) the bypass channel 208. The plate bypass 220 may be in full alignment with (open to) the bypass channel 208 as shown in FIG. 3B. As shown in FIG. 3D, the plate bypass 220 may completely block (close) the flow of fluid through the bypass channel 208. As fluid is blocked from flowing into the bypass channel 208, the fluid continues through the flow passages 226 in the valve plate 200 and into the rotor channel 204.

The selective fluid communication through the plate bypass 220 and into the bypass channel 208 bypasses a portion of the fluid passing through the rotor channel 204. These interruptions provide fluid pulses through the motor 9. These fluid pulses may be used to manipulate the torque of the motor 9. These fluid pulses may also be used to alter the flow out of the drill bit thereby dislodging particles about the bit which may cause the tool to stick in the wellbore.

The selective fluid communication of the valve plate 200 with the bypass channel 208 provides a variable area for the passage of fluid. Because the flow area through the plate bypass 220 (and/or 220') and into the bypass channel 208 may vary as the motor rotor 206 rotates, variable flow through the motor may be established. Because the fluid may accelerate and decelerate as the plate bypass 220 and bypass channel 208 rotate relative each other, a 'water hammer' force may be generated along the longitudinal axis of the drilling motor 9.

The plate bypass 220 may be used to define a fluid path through the valve plate 200 and through the bypass channel 208. The flow of fluid through the bypass channel 208 reduces the fluid passing between the motor rotor 206 and the motor stator 202, thereby reducing the torque (and/or RPMs) of the drilling motor 9. This reduction in torque may briefly slow the bit, and may also provide a 'hammering effect' in the torque at the bit. This 'hammering effect' may generate a force that creates torque fluctuations due to the variation in pressure pulses as the valve plate 200 is selectively aligned (opened, partially opened and/or closed). The varied flow may also be used to power additional tools in the bottom hole assembly (BHA). For example, high pressure fluid may be bypassed to other downhole tools, such as torsional drilling hammers, axial drilling hammers, flow pulsers/modulators, drill bits, hole openers, stabilizers, and other known types of downhole tools below the drilling motor using fluid with the full pressure available to the motor.

Figure 4A:
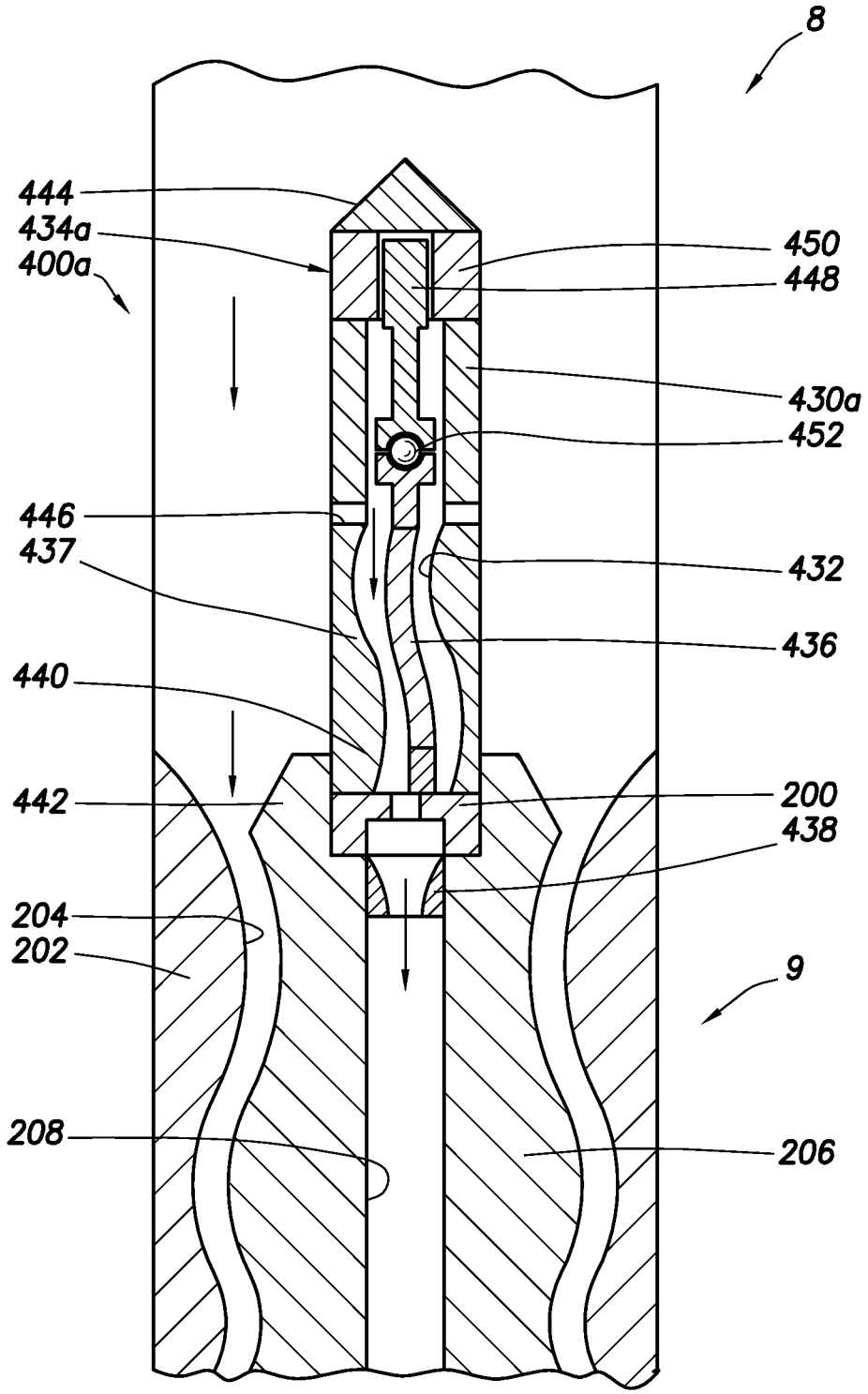
FIGS. 4A and 4B are schematic, longitudinal cross-sectional views of a portion of a downhole tool depicting various configurations of a motor with a valve plate and a regulator in accordance with the disclosure.
Figure 4B:
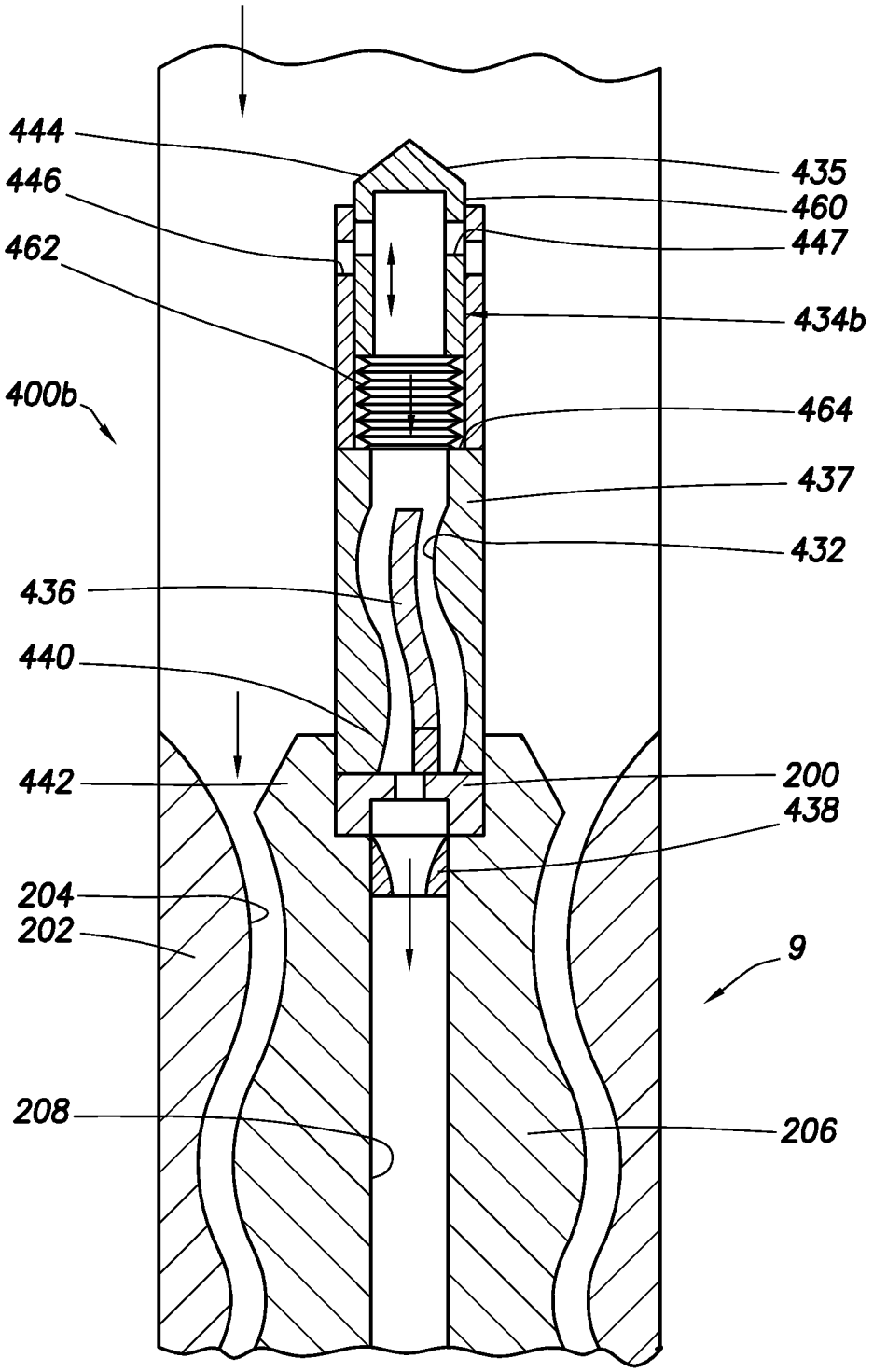

FIGS. 4A-4B show schematic views of the motor 9 of the BHA 8 of FIG. 1 provided with valve plate 200 and regulators 400*a* and 400*b*, respectively. The regulators 400*a,b* may be configured to selectively restrict the flow of fluid into the valve plate 200 and motor 9 to cause varying torque available to the motor 9. This varied torque caused by the interrupted flow may be used to create a torsional impact, or 'hammer effect.'

FIG. 4A depicts a 'slip-jaw' regulator 400*a* positioned upstream of the motor 9 and valve plate 200. The regulator 400*a* includes a regulator housing 430*a* having a passageway 432 therethrough, a clutch 434*a*, regulator rotor 436, a regulator stator 437, and a nozzle 438.

A lower end 440 of the housing 430*a* may be inserted into an uphole end (or tail thread) 442 of the motor rotor 206 and extends a distance uphole therefrom. The valve plate 200 is positioned adjacent to the uphole end 442 of the motor rotor 206. The housing 430*a* has a tubular body terminating at a tip 444. The housing 430*a* has apertures 446 therethrough for allowing fluid to pass into the passageway 432, through the nozzle 438 and into the bypass channel 208 as indicated by the arrows.

As fluid flows through the passageway 432, the fluid rotationally drives the regulator rotor 436 within the regulator stator 437 in the same manner as the motor rotor 206 and motor stator 202. The clutch 434*a* is operated to restrict the fluid flowing through the passageway 432 at a given pressure, thereby restricting the rotation of the regulator rotor 436 and the passage of fluid into the bypass channel 208.

The clutch 434*a* and the regulator rotor 436 are rotationally positioned in the passageway 432 of the housing 430*a*. The clutch 434*a* includes a drive shaft 448 and a brake 450 adjacent the tip 444. The regulator rotor 436 is operatively connected to a downstream end of the drive shaft 448 by a connector 452, such as a u-joint. The rotation of the regulator rotor 436 may be used to alter the flow of fluid as it passes through the passageway 432 and into the bypass channel 208. Eccentric motion of the regulator rotor 436 selectively opens and closes the passageway 432 at the lower end 440 of the housing. This motion creates a pressure pulse above the motor 9 which may be used to create a torque pulse across the motor 9.

The brake 450 may continuously engage the drive shaft 448 as it rotates as indicated by the arrows. When pressure of the fluid exceeds a given level, a resistance of the brake 450 may be overcome to permit rotation of the regulator rotor 436. The brake 450 may be set at a given resistance such that the regulator rotor 436 may be permitted to operate at, for example, a given pressure set point. For example, at a given pressure, the clutch 434*a* may be activated to permit the regulator rotor 436 to engage and effectively 'turn off' flow (or close) flow through the regulator 400*a*. This configuration allows the clutch regulator 400*a* to act as a 'slip-jaw' clutch to adjust the pressure required to interrupt fluid flow. The interrupted fluid flow may be used to provide the torsional 'hammer effect.'

FIG. 4B depicts a spring regulator 400*b* positioned at an uphole end of the motor rotor 206. The spring regulator 400*b* operates similarly to the slip jaw regulator of FIG. 4A to selectively permit rotation of the regulator rotor 436. The spring regulator 400*b* includes a regulator housing 430*b* having a passage 432 therethrough, a clutch 434*b*, a clutch housing 435, the regulator rotor 436, the regulator stator 437, and the nozzle 438.

The lower end 440 of the housing 430*b* may be inserted into the uphole end (or tail thread) 442 of the motor rotor 206 and extends a distance uphole therefrom. The valve plate 200 is positioned adjacent to the uphole end 442 of the motor rotor 206. The regulator housing 430*b* has a tubular body with the clutch 434*b* positioned in an upper end thereof. The clutch housing 435 extends a distance from the upper end of the regulator housing 430*b* and terminates at the tip 444. The regulator housing 430*b* has apertures 446 therethrough and the clutch housing 435 has apertures 447 therethrough for selectively allowing fluid to pass into the passageway 432. When the apertures 446 of regulator housing 430*b* align with the apertures 447 of the clutch housing 435, fluid is permitted to pass through passageway 432, through the nozzle 438 and into the bypass channel 208 as indicated by the arrows.

The clutch 434*b* is slidably positioned in the clutch housing 435. The clutch 434*b* includes sliding piston 460 and springs 462 mounted onto shoulders 464 of the housing 430*b*. The regulator rotor 436 is rotationally positionable in the housing and activated by the sliding piston 460. The rotation of the regulator rotor 436 may be used to alter the flow of fluid as it passes through the passageway 432 and into the bypass channel 208. Eccentric motion of the regulator rotor 436 selectively opens and closes the passageway 432 at the lower end 440 of the housing 430*b*. This motion creates a pressure pulse above the motor 9 which may be used to create a torque pulse across the motor 9.

The clutch 434*b* may be selectively activated by, for example, fluid passing into the housing 430*b*. The sliding piston 460 is slidably movable in the passageway 432 as indicated by the arrows. The sliding piston 460 may compress spring 462 as pressure increases. As pressure increases, the sliding piston 460 is retraced into housing 430*b* and the apertures 446 move into alignment with the apertures 447. In this position, fluid may be permitted to flow through the apertures 447 and into the passageway 432. In this manner, the clutch 434*b* may open and close in response to pressure applied to the regulator 400*b*. The spring 462 may be configured such that a given pressure may overcome a force of the spring 462 and retract the sliding piston 460 into the open position. The opening and closing of the regulator 400*b* by the sliding piston 460 may be used to interrupt flow of fluid therethrough. The interrupted fluid flow may be used to provide the torsional 'hammer effect.'

In operation, the regulators 400*a,b* of FIGS. 4A and 4B may be used to adjust the flow to valve plate 200 and/or into the motor 9. The regulators 400*a,b* may meter the flow of fluid through the bypass channel 208 thereby bypassing the power section of the motor 9. The 'pulsed' flow through the bypass channel 434 may be used to generate a pressure spike above a pressure of the downhole motor 9. The pressure spikes provide the 'hammering' effect in the torque at the bit. The regulators 400*a,b* may be oscillated continuously thereby pulsing the flow, or periodically using the clutch 434*a,b* to 'pop-off' such that the pulsing effect only occurs at a pre-set pressure and/or torque level. This pulsing may be used to minimize drill string torsional and/or lateral vibration. This pulsing may also be used to dislodge material at the bit and/or to aid in the prevention of stick-slip.

While FIGS. 4A and 4B depict a specific clutch, other clutches capable of selectively controlling fluid flow may be used in the regulator, such as slip, jaw, magneto-rheological fluid, viscous, or other type of control mechanism.

Figure 5A:
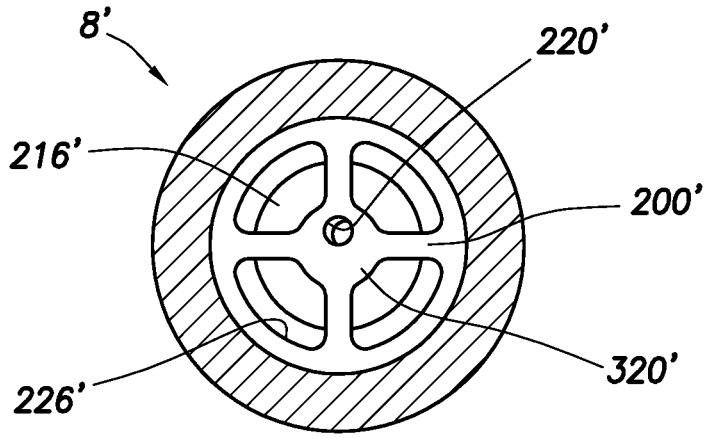
FIGS. 5A and 5B are schematic, radial and longitudinal cross-sectional views, respectively, of a portion of a downhole tool having a drilling motor with an alternative valve.
Figure 5B:
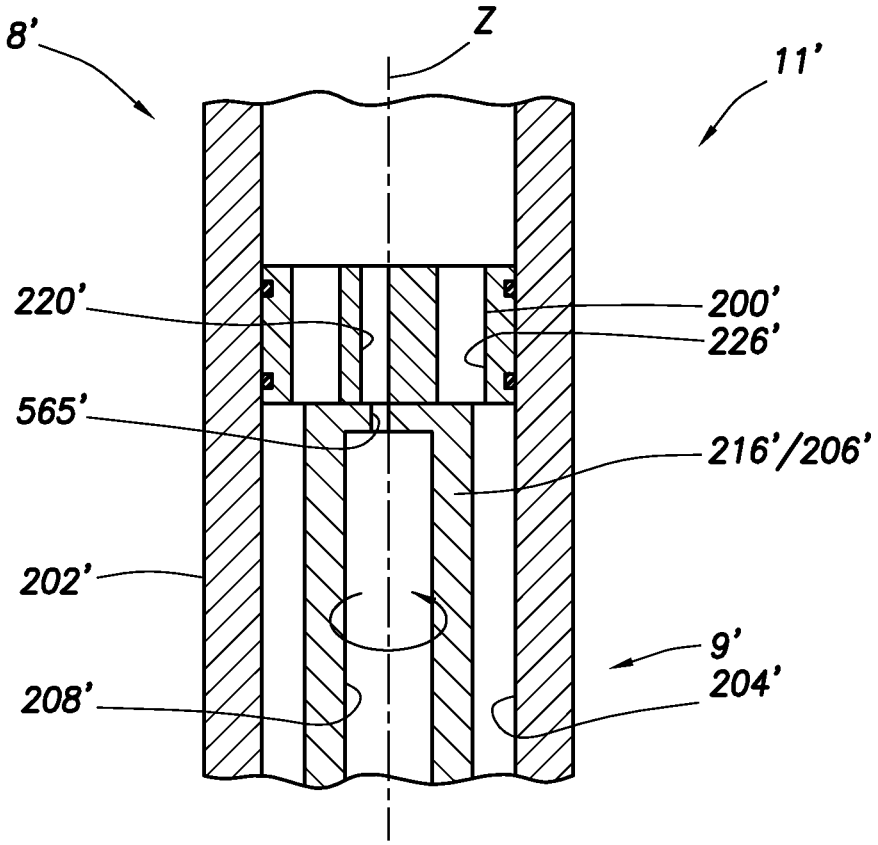

FIGS. 5A and 5B show schematic horizontal and longitudinal cross-sectional views, respectively, of a portion of an alternate downhole tool 8' with an alternate motor 9' and valve 11' usable in place of the downhole tool 8, motor 9 and valve 11 of FIG. 1. The alternate valve 11' is similar to the valve 11 of FIG. 2A, except that, in this version, the valve 11' includes a valve plate (or wear plate) 200' with a wear tip 216' adjacent thereto. The valve plate 200' is similar to the valve plate of FIGS. 3A-3F, except that a single offcenter bypass 220' is provided through the hub 320'.

The wear tip 216' is similar to the wear tip 216 of FIGS. 2A and 2B, except that the wear tip 216' has an offcenter passageway 565' therethrough in fluid communication with the offcenter bypass 220', and a passage 226' therethrough in fluid communication with a rotor channel 204'. The offcenter bypass 220' and the offcenter passageway 565' are offcenter with respect to an axis of rotation Z of the wear tip 216'.

The wear tip 216' is coupled to and rotationally driven by the motor 9'. In the configuration of FIG. 5B, the motor 9' is a turbine motor, but may be a conventional drilling motor rotationally driven by the flow of fluid therethrough. The turbine motor 9' has a turbine rotor 206' positioned in a housing 202' with the rotor channel 204' therebetween. The turbine motor 9' has a bypass channel 208' therethrough for bypassing a portion of fluid therethrough. In some cases, the wear tip 216' may be integral with turbine rotor 206' so these items are depicted as a unitary feature in FIG. 5B. The wear tip 216' may be directly connected to a turbine motor 9' for rotation therewith, or indirectly linked to the turbine motor 9' for rotation therewith via intervening components (e.g., rotor catch 212) as shown in FIGS. 2A and 2B.

In operation, fluid passes through the passage 226' of the valve plate 200' and into the rotor channel 204'. The rotor 206' and the wear tip 216' is rotated about the Z-axis by flow of fluid through the rotor channel 204'. During such rotation, the wear tip 216' rotates adjacent to the valve plate 200'. As the wear tip 216' rotates, the offcenter passageway 565' is sometimes in alignment with the offcenter bypass 220', thereby providing selective fluid communication therebetween. Fluid passing into the offcenter bypass 220' flows through the offcenter passageway 565' and into bypass channel 208' when in partial or full alignment therewith. Fluid passing through the downhole tool 8' and into the offcenter bypass 220' is prevented from passing through the offcenter passageway 565' and into bypass channel 208 when in non-alignment therewith. This selective communication provides the hammering effect in similar manner as the selective fluid communication of bypass 220 of FIGS. 3A-3E.

Figure 6:
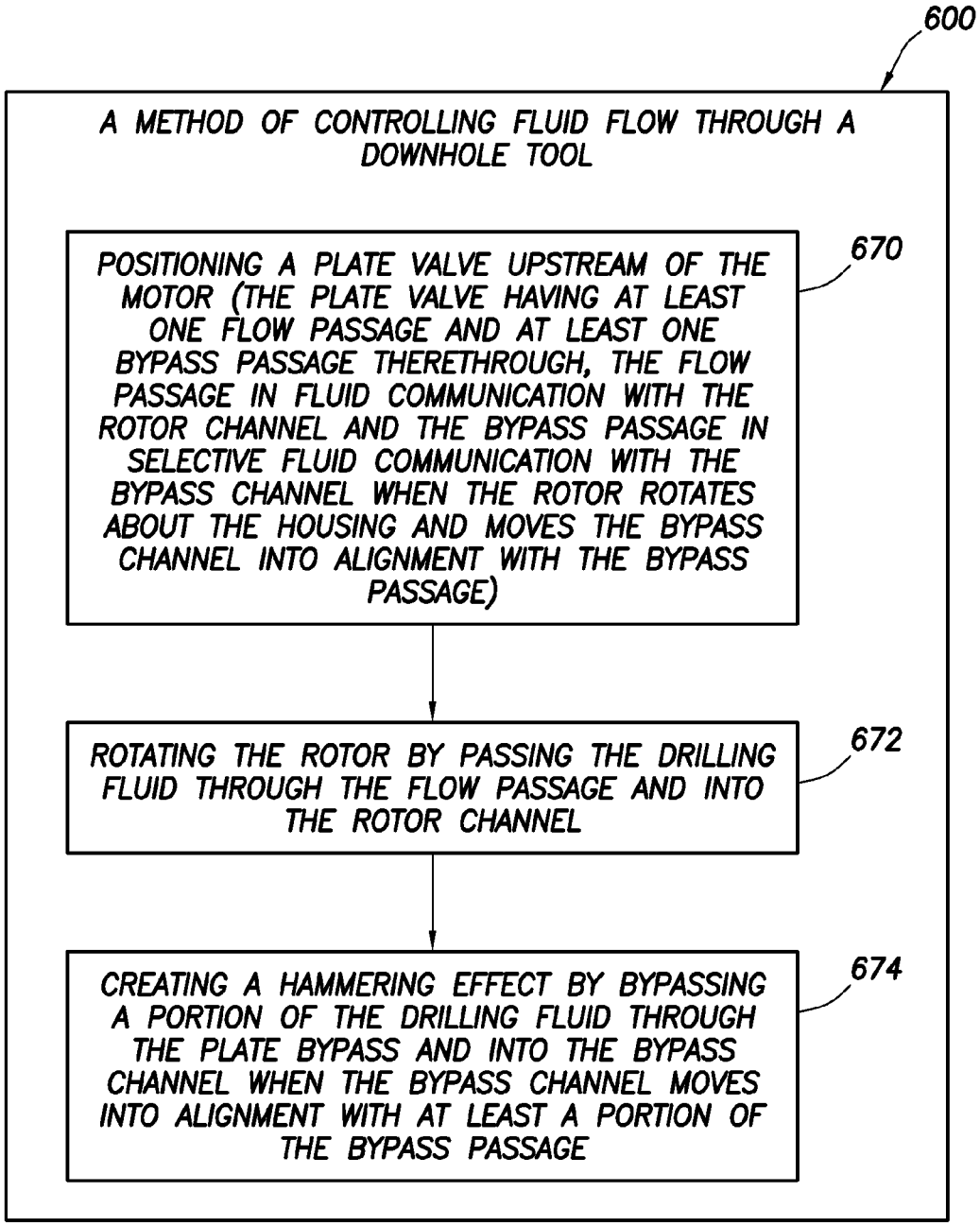
FIG. 6 is a flow chart depicting a method of controlling flow through a downhole tool.

FIG. 6 depicts a method 600 of controlling fluid flow through a downhole tool. The method involves positioning (670) a valve plate upstream of the motor (the valve plate having at least one flow passage and at least one bypass passage therethrough, the flow passage in fluid communication with the rotor channel and the bypass passage in selective fluid communication with the bypass channel when the rotor rotates about the housing and moves the bypass channel into alignment with the bypass passage), rotating (672) the rotor by passing the drilling fluid through the flow passage and into the rotor channel, and creating (674) a hammering effect by bypassing a portion of the drilling fluid through the plate bypass and into the bypass channel when the bypass channel moves into alignment with at least a portion of the bypass passage. The method may also involve regulating fluid flow into the valve plate. The regulating may involve selectively passing fluid into the bypass channel. The hammering effect may induce an axial and/or radial torsional effect. The method may be repeated and performed in an order as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the disclosure may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more valves with one or more regulators and/or valve plates may be positioned about various types of rotors in the downhole tool.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A valve for controlling the flow of a drilling fluid through a downhole tool positionable in a wellbore penetrating a subterranean formation, the downhole tool comprising a drill bit at an end thereof and a drilling motor, the drilling motor comprising a housing with a rotor movable in a rotor channel in the housing as the drilling fluid passes therethrough, the rotor having a bypass channel for bypassing a portion of the drilling fluid therethrough, the valve comprising:

a valve plate positionable upstream of the motor, the valve plate having at least one flow passage and at least one bypass passage therethrough, the at least one flow passage in fluid communication with the rotor channel for passing the drilling fluid therethrough whereby the rotor is rotatable in the housing, the at least one bypass passage in selective fluid communication with the bypass channel when the rotor moves about the housing and the bypass channel selectively moves into and out of alignment with at least a portion of the at least one bypass passage for bypassing a portion of the drilling fluid therethrough whereby a hammering effect is generated on the bit.

2. The valve of claim 1, wherein the rotor comprises a helical rotor orbiting within a helical stator in the housing.

3. The valve of claim 1, wherein the rotor comprises a turbine rotatable within the housing.

4. The valve of claim 3, wherein the at least one bypass passage is offcenter to an axis of rotation of the rotor.

5. The valve of claim 4, wherein the rotor channel is offcenter to the axis of rotation of the rotor.

6. The valve of claim 1, wherein the valve plate comprises a central hub and an outer ring with at least one spoke defining at least one rotor passage therebetween.

7. The valve of claim 1, further comprising a nozzle.

8. The valve of claim 1, further comprising a rotor catch.

9. The valve of claim 1, further comprising a catch ring.

10. The valve of claim 1, further comprising a wear tip.

11. The valve of claim 10, wherein the wear tip is directly coupled to the rotor.

12. The valve of claim 10, wherein the wear tip is indirectly coupled to the rotor.

13. The valve of claim 1, wherein the at least one bypass passage comprises a plurality of bypass passages.

14. The valve of claim 1, wherein the bypass channel is positionable in one of full alignment, partial alignment, and non-alignment with the bypass passage.

15. A downhole tool positionable in a wellbore penetrating a subterranean formation, the downhole drilling tool having a drill string with drill bit at an end thereof and a drilling fluid passing therethrough, the downhole tool comprising:

a drilling motor positionable in the drill string, the drilling motor comprising:

a housing;

a rotor movable in a rotor channel in the housing as the drilling fluid passes therethrough, the rotor having a bypass channel for bypassing a portion the drilling fluid therethrough; and a valve positionable upstream of the motor for controlling the flow of the drilling fluid therethrough, the valve comprising:

a valve plate positionable upstream of the motor, the valve plate having at least one flow passage and at least one bypass passage therethrough, the at least one flow passage in fluid communication with the rotor channel for passing the drilling fluid therethrough whereby the rotor is rotatable in the housing, the at least one bypass passage in selective fluid communication with the bypass channel when the rotor moves about the housing and the bypass channel selectively moves into and out of alignment with at least a portion of the at least one bypass passage for bypassing a portion of the drilling fluid therethrough whereby a hammering effect is generated on the bit.

16. The downhole tool of claim 15, wherein the motor further comprises a helical stator and the rotor comprises a helical rotor orbiting therein.

17. The downhole tool of claim 15, wherein the rotor comprises a turbine rotatable about an axis of the downhole tool.

18. A method of controlling the flow of a drilling fluid through a downhole tool positionable in a wellbore penetrating a subterranean formation, the downhole tool comprising a drill bit at an end thereof and a drilling motor, the drilling motor comprising a housing with a rotor movable in a rotor channel in the housing as the drilling fluid passes therethrough, the rotor having a bypass channel for bypassing a portion of the drilling fluid therethrough, the method comprising:

positioning a valve plate upstream of the motor, the valve plate having at least one flow passage and at least one bypass passage therethrough, the at least one flow passage in fluid communication with the rotor channel, the at least one bypass passage in selective fluid communication with the bypass channel when the rotor rotates about the housing;

rotating the rotor by passing the drilling fluid through the at least one flow passage and into the rotor channel;

moving the bypass channel into and out of alignment with the at least one bypass passage while rotating the rotor; and creating a hammering effect by bypassing a portion of the drilling fluid through the at least one plate bypass and into the bypass channel when the bypass channel moves into alignment with at least a portion of the at least one bypass passage.

* * * * *